US008484898B2

(12) United States Patent
Ohishi

(10) Patent No.: US 8,484,898 B2
(45) **Date of Patent: *Jul. 16, 2013**

(54) NATURAL VENTILATOR APPARATUS

(75) Inventor: Mamoru Ohishi, Ritto (JP)

(73) Assignee: Oiles Corporation, Tokyo (JP)

( * ) Notice: Subject to any disclaimer, the term of this patent is extended or adjusted under 35 U.S.C. 154(b) by 339 days.

This patent is subject to a terminal disclaimer.

(21) Appl. No.: 12/599,574

(22) PCT Filed: Sep. 21, 2007

(86) PCT No.: PCT/JP2007/001030

§ 371 (c)(1),
(2), (4) Date: Nov. 10, 2009

(87) PCT Pub. No.: WO2008/142738

PCT Pub. Date: Nov. 27, 2008

(65) Prior Publication Data

US 2010/0299998 A1 Dec. 2, 2010

(30) Foreign Application Priority Data

May 18, 2007 (JP) ..... 2007-133185

(51) Int. Cl.
*E05D 15/30* (2006.01)

(52) U.S. Cl.
USPC ..... 49/252; 49/250; 49/246; 49/260; 49/213; 49/216

(58) Field of Classification Search
USPC ..... 49/216, 213, 209, 211, 252, 250, 49/253, 246, 247, 260
See application file for complete search history.

(56) References Cited

U.S. PATENT DOCUMENTS

| | | | | | |
|---|---|---|---|---|---|
| 1,266,922 | A | * | 5/1918 | Criswell | 49/130 |
| 3,101,135 | A | * | 8/1963 | Neal et al. | 49/248 |
| 3,484,993 | A | * | 12/1969 | Erb et al. | 49/216 |
| 4,486,978 | A | * | 12/1984 | Frank | 49/153 |
| 4,555,829 | A | * | 12/1985 | Davis | 16/342 |

(Continued)

FOREIGN PATENT DOCUMENTS

| | | |
|---|---|---|
| JP | 4-8763 | 3/1992 |
| JP | 4-8763 Y2 | 3/1992 |

(Continued)

OTHER PUBLICATIONS

Microfilm of the specification and drawings annexed to the request of Japanese Utility Model Application No. 37010/1983 (Laid-open No. 142372/1984), Sep. 22, 1984.

(Continued)

*Primary Examiner* — Katherine Mitchell
*Assistant Examiner* — Marcus Menezes
(74) *Attorney, Agent, or Firm* — Nixon & Vanderhye, PC

(57) ABSTRACT

A natural ventilation apparatus 1 includes a window frame 2 which is installed in a building; a framed panel 4 disposed in an opening portion 3 defined by the window frame 2; and opening/closing means 5 for opening and closing the opening portion 3 on the basis of an air current. The opening portion 3 is adapted to be opened by the opening portion opening movement of the framed panel 4 moving toward a building exterior 7 side, and to be closed by the opening portion closing movement of the framed panel 4 moving toward a building interior 8 side.

7 Claims, 8 Drawing Sheets

U.S. PATENT DOCUMENTS

| | | | | |
|---|---|---|---|---|
| 4,996,794 | A * | 3/1991 | Daniel | 49/250 |
| 5,185,955 | A * | 2/1993 | Pedersen | 49/216 |
| 5,864,989 | A * | 2/1999 | Funatsu et al. | 52/1 |
| 6,018,911 | A * | 2/2000 | Menegazzo | 49/213 |
| 6,386,621 | B1 * | 5/2002 | Kozak et al. | 296/155 |
| 7,305,795 | B1 * | 12/2007 | Tooman | 49/164 |

FOREIGN PATENT DOCUMENTS

| | | |
|---|---|---|
| JP | 10-18457 | 1/1998 |
| JP | 10-18457 A | 1/1998 |
| JP | 2003-247371 | 9/2003 |
| JP | 2003-247371 A | 9/2003 |

OTHER PUBLICATIONS

Microfilm of the specification and drawings annexed to the request of Japanese Utility Model Appln. No. 37010/1983 (Laid-open No. 142372/1984) (Sumitomo Uoru Sisutemu Kabushiki Kaisha), Sep. 22, 1984, p. 1, line 14 to p. 4, line 17; Figs. 1 to 3.

* cited by examiner

NATURAL VENTILATOR APPARATUS

This application is the U.S. national phase of International Application No. PCT/JP2007/001030, filed 21 Sep. 2007, which designated the U.S. and claims priority to Japanese Patent Application No. 2007-133185, filed 18 May 2007, the entire contents of each of which are hereby incorporated by reference.

TECHNICAL FIELD

The present invention relates to a natural ventilation apparatus for naturally opening and closing an opening portion of a building by the opening and closing movement of a framed panel based on an air current so as to adjust the amount of air flow between the interior and the exterior of the building.

BACKGROUND ART

[Patent Document 1] JP-A-2003-247371

A proposal has been made in patent document 1, for example, for a natural ventilation apparatus which is comprised of a main arm having one end pivotally secured to an upper portion of a stile of a framed panel and another end pivotally secured to a vertical frame (jamb) of a window frame at a position lower than the one end, as well as a sub arm having one end pivotally secured to an intermediate portion of the stile and another end pivotally secured to a lower portion of the vertical frame, the sub arm being longer than the main arm. The one end of the sub arm and the center of gravity of the framed panel with the window closed are respectively disposed so as to be located on an identical line extending in a vertical direction.

DISCLOSURE OF THE INVENTION

Problems that the Invention is to Solve

In such a natural ventilation apparatus, in the light of relationships involving such as the rotation of the main arm and the sub arm and the respective positions of the one end of the sub arm and the center of gravity of the framed panel, the rotational moment toward an open position of the opening portion of the building, which is imparted to the framed panel, increases when the window is opened. Therefore, it is difficult to cause the framed panel to undergo opening portion opening/closing movement by a small force based on an air current in the case where the framed panel is located in the opening portion open position or its vicinity, and it is difficult to not cause the framed panel to undergo the opening portion closing movement by a force based on the air current in the case where the framed panel is located in the vicinity of the opening portion closed position.

The present invention has been devised in view of the above-described aspects, and its object is to provide a natural ventilation apparatus which is capable of ensuring that in the case where the framed panel is located in the opening portion open position or its vicinity, the framed panel is allowed to undergo the opening portion opening/closing movement by a small force based on the air current, whereas in the case where the framed panel is located in the vicinity of the opening portion closed position, the framed panel is not allowed to undergo the opening portion closing movement by the force based on the air current, thereby making it possible to suitably provide ventilation by the opening/closing movement, based on the air current, of the framed panel located in the opening portion open position or its vicinity.

Means for Solving the Problems

A natural ventilation apparatus in accordance with the invention comprises: a window frame which is installed in a building; a framed panel disposed in an opening portion defined by the window frame; and opening/closing means for opening and closing the opening portion on the basis of an air current, wherein the opening/closing means includes a first supporting mechanism for supporting one portion of the framed panel liftably and a second supporting mechanism for supporting another portion of the framed panel, which is located below the one portion of said framed panel, movably in a direction toward an interior or exterior of the building, the second supporting mechanism having a support member for supporting the other portion of the framed panel by a supporting surface movably in the direction toward the interior or exterior of the building, the supporting surface being inclined upward from a building exterior side toward a building interior side with respect to a horizontal line, an angle of inclination of the supporting surface with respect to the horizontal line increasing gradually from the building exterior side toward the building interior side.

According to the natural ventilation apparatus in accordance with the invention, the opening/closing means particularly includes the first supporting mechanism and the second supporting mechanism, and the second supporting mechanism has the support member for supporting the other portion of the framed panel by the supporting surface movably in the direction toward the interior or exterior of the building. The supporting surface is inclined upward from the building exterior side toward the building interior side with respect to the horizontal line, and the angle of inclination of the supporting surface with respect to the horizontal line increases gradually from the building exterior side toward the building interior side. Therefore, it is possible to ensure that in the case where the framed panel is located in the opening portion open position or its vicinity, the framed panel is allowed to undergo the opening portion opening/closing movement by a small force based on the air current, whereas in the case where the framed panel is located in the vicinity of the opening portion closed position, the framed panel is not allowed to undergo the opening portion closing movement by the force based on the air current. Thus, it is possible to suitably provide ventilation by the opening/closing movement, based on the air current, of the framed panel located in the opening portion open position or its vicinity.

In a preferred example of the natural ventilation apparatus in accordance with the invention, the support member has an end side supporting surface which is continuous to an end portion on the building exterior side of the supporting surface and abuts against the other portion of the framed panel to support the other portion movably in the direction toward the interior or exterior of the building, the end side supporting surface being inclined downward from the building exterior side toward the building interior side. According to such a preferred example, with respect to the other portion of the framed panel abutting against the end side supporting surface, a counter moving force resisting the opening portion opening movement force can be imparted to the framed panel, thereby making it possible to prevent the rapid opening portion opening movement of the framed panel located in the opening portion open position or its vicinity.

In another preferred example of the natural ventilation apparatus in accordance with the invention, the natural ventilation apparatus further comprises: a rotating shaft which connects the support member to the window frame rotatably about a horizontal axis, so as to be located on the building interior side and on a lower side with respect to the other portion of the framed panel in a state of being supported by the support member movably in the direction toward the interior or exterior of the building, and a holding mechanism for holding the support member in a state in which the support member supports the other portion of the framed panel movably in the direction toward the interior or exterior of the building. According to such a preferred example, as the support member undergoes rotation toward the building interior side, the support member is not caused to project toward either the building interior side or the building exterior side when the framed panel is in the opening portion closed position.

In still another preferred example of the natural ventilation apparatus in accordance with the invention, the natural ventilation apparatus further comprises: another support member which is fitted to the window frame and supports the other portion of the framed panel by another supporting surface movably in the direction toward the interior or exterior of the building, the other supporting surface being inclined upward from the building exterior side toward the building interior side with respect to the horizontal line, such that the support of the other portion of the framed panel is shifted from the supporting surface to the other supporting surface, an angle of inclination of the other supporting surface with respect to the horizontal line increasing gradually from the building exterior side toward the building interior side. According to such a preferred example, even in the case where the framed panel is located in the opening portion closed position or its vicinity, an opening portion opening movement force can be imparted to the framed panel as a counter moving force resisting the opening portion closing movement force based on the air current. In addition, the opening portion opening movement of the framed panel in the opening portion closed position or its vicinity can be effected smoothly.

In a further preferred example of the natural ventilation apparatus in accordance with the invention, the angle of inclination of the other supporting surface with respect to the horizontal line is greater than a maximum angle of inclination of the supporting surface with respect to the horizontal line. According to such a preferred example, the closing of the opening portion is not effected rapidly, so that it is possible to prevent the occurrence of a situation such as the slamming of the framed panel against the window frame, and the opening portion opening movement of the framed panel in the opening portion closed position or its vicinity can be effected more smoothly.

In a still further preferred example of the natural ventilation apparatus in accordance with the invention, the other portion of the framed panel in an opening portion open position and a center of gravity of the framed panel are respectively located on an identical straight line extending in a vertical direction. According to such a preferred example, it is possible to balance the framed panel in the opening portion open position without needing to install a weight or the like on the framed panel, and it is possible to stop the opening portion opening movement of the framed panel without using a stopper or the like. Moreover, the framed panel can be made stationary in the opening portion open position so that the framed panel can generate the opening portion opening/closing movement with a small force based on the air current.

In a further preferred example of the natural ventilation apparatus in accordance with the invention, the opening/closing means has engaging means for causing the framed panel in an opening portion closed position to engage the window frame.

Advantages of the Invention

According to the invention, it is possible to provide a natural ventilation apparatus which is capable of ensuring that in the case where the framed panel is located in the opening portion open position or its vicinity, the framed panel is allowed to undergo the opening portion opening/closing movement by a small force based on the air current, whereas in the case where the framed panel is located in the vicinity of the opening portion closed position, the framed panel is not allowed to undergo the opening portion closing movement by the force based on the air current, thereby making it possible to suitably provide ventilation by the opening/closing movement, based on the air current, of the framed panel located in the opening portion open position or its vicinity.

Next, a more detailed description will be given of a mode for carrying out the invention with reference to the preferred embodiments illustrated in the drawings. It should be noted that the invention is not limited to these embodiments.

BEST MODE FOR CARRYING OUT THE INVENTION

Figure 1:
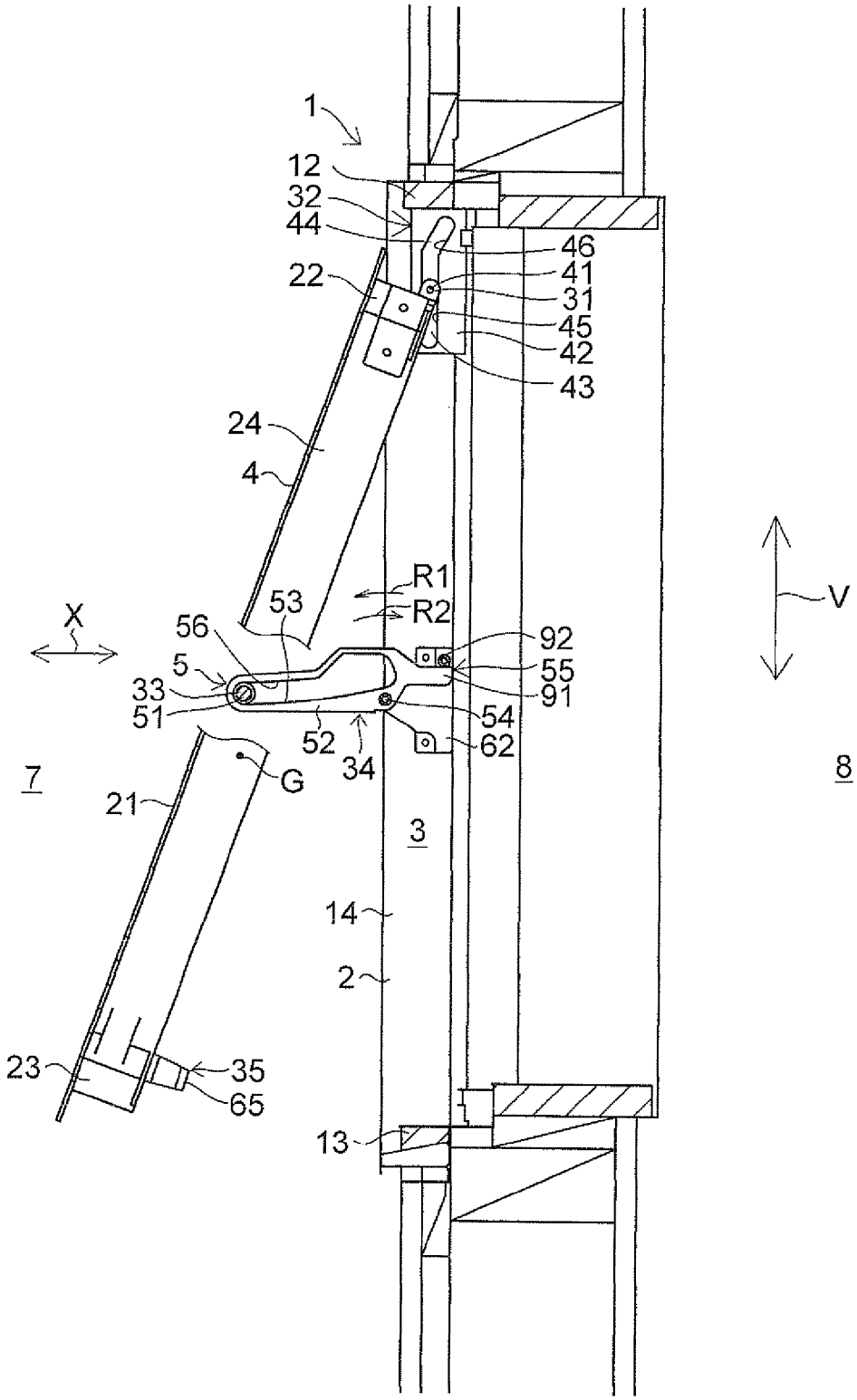
FIG. 1 is an explanatory side elevational view in a case where a framed panel in accordance with an embodiment of the invention is in an opening portion open position.
Figure 2:
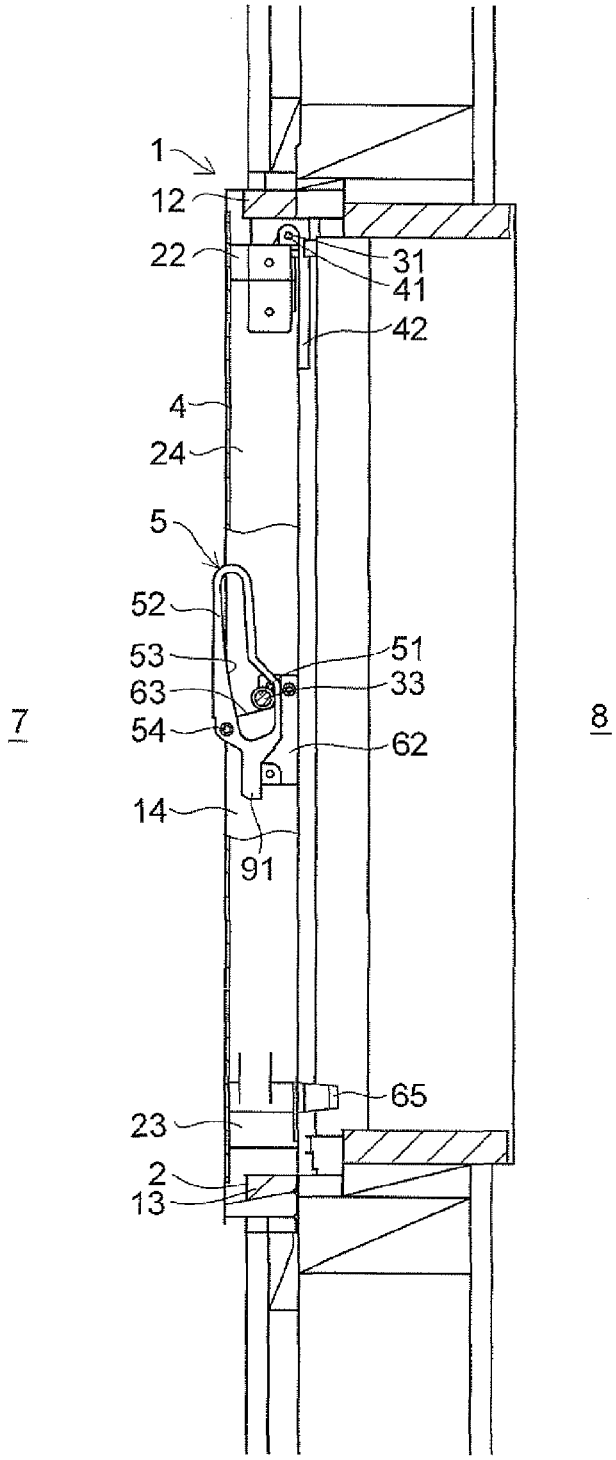
FIG. 2 is an explanatory side elevational view in a case where the framed panel of the embodiment shown in FIG. 1 is in an opening portion closed position.
Figure 3:
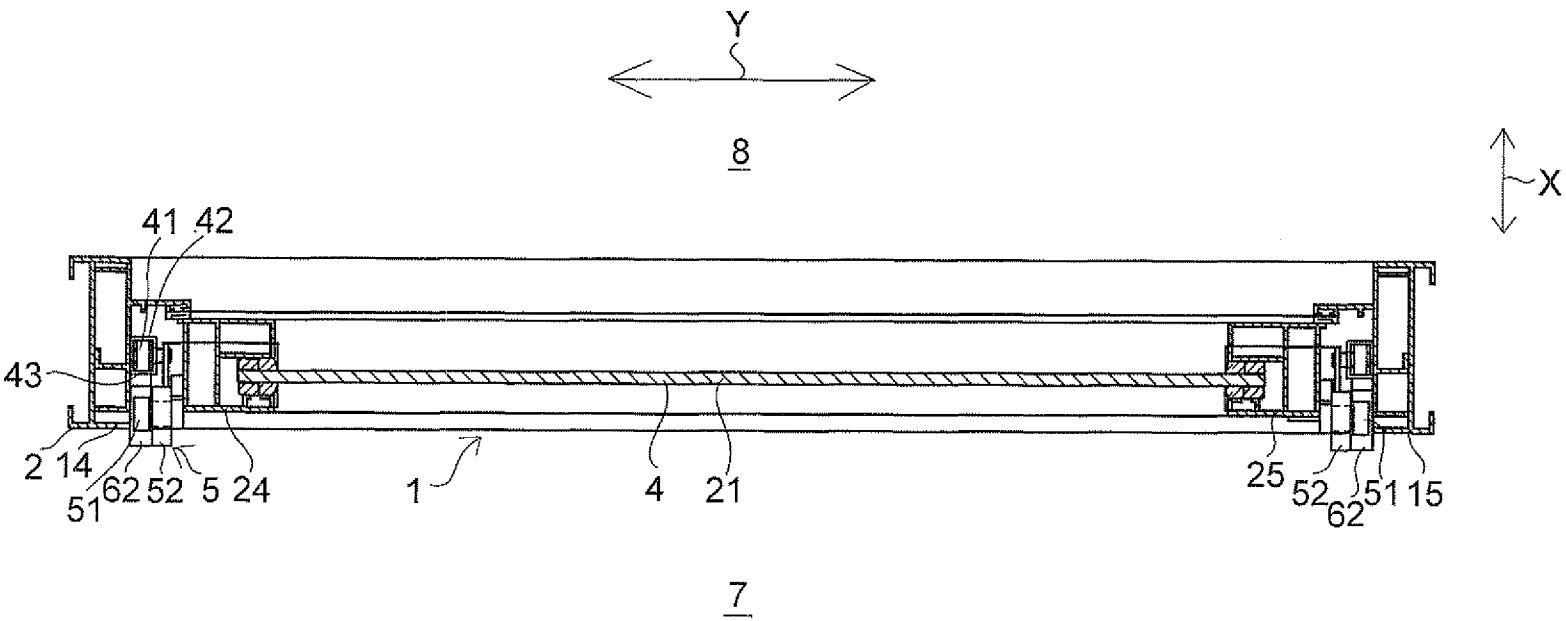
FIG. 3 is an explanatory plan view in a case where the framed panel of the embodiment shown in FIG. 1 is in the opening portion closed position.

In FIGS. 1 to 8, a natural ventilation apparatus 1 in accordance with this embodiment is comprised of a window frame 2 which is installed in a building (not shown), a framed panel 4 which is disposed in an opening portion 3 defined by the window frame 2 and opens and closes the opening portion 3, and an opening/closing means 5 for opening and closing the opening portion 3 by the framed panel 4 on the basis of an air current. The natural ventilation apparatus 1 is adapted to open the opening portion 3, as shown in FIG. 1, by the opening portion opening movement of the framed panel 4 moving toward a building exterior 7 side, and is adapted to close the opening portion 3, as shown in FIG. 2, by the opening portion closing movement of the framed panel 4 moving toward a building interior 8 side. FIG. 1 shows a state in which the framed panel 4 is in an opening portion closed position, and FIGS. 2 and 3 show a state in which the frame panel 4 is in an opening portion closed position.

The window frame 2 has an upper frame 12, a lower frame 13, and a pair of vertical frames 14 and 15. A seal member for abutting against the framed panel 4 in the opening portion open position shown in FIG. 1 is fitted to those portions of the upper frame 12, the lower frame 13, and the vertical frames 14 and 15 that abut against the framed panel 4.

The framed panel 4 is fitted to the window frame 2 by means of the opening/closing means 5 so that the opening portion 3 can be freely opened and closed. The framed panel 4 has a rectangular framed panel body 21 constituted by a glass plate or the like, a top rail 22, a bottom rail 23, and a pair of stiles 24 and 25. The peripheries of the framed panel body 21 are covered by the top rail 22, the bottom rail 23, and the pair of stiles 24 and 25. The framed panel 4 assumes a stationary state in the opening portion open position, and is adapted to narrow the opening portion 3 by the opening portion closing movement based on the air current and to expand the opening portion 3 by the opening portion opening movement based on the air current.

The opening/closing means 5 includes a supporting mechanism 32 adapted to support a portion 31 on the top rail 22 side of the framed panel 4 liftably; a supporting mechanism 34 adapted to support another portion 33 of the framed panel 4, which is located below the portion 31, movably in a direction X toward the interior or exterior of the building; and an engaging means 35 for causing the framed panel 4 in the opening portion closed position to engage the window frame 2. The supporting mechanisms 32 and 34 respectively support the portions 31 and 33 rotatably about a horizontal axis extending in a lateral direction Y. The portions 31 and 33 are respectively provided in the stiles 24 and 25. The lateral direction Y is perpendicular to a vertical direction V and the direction X toward the interior or exterior of the building. The direction X toward the interior or exterior of the building is a direction parallel to a horizontal direction and perpendicular to the lateral direction Y.

The supporting mechanism 32 includes a shaft body 41 which is fitted in the respective one of the portion 31 of the stile 24 and the portion 31 of the stile 25 and is raised or lowered with respect to the vertical frames 14 and 15, as well as a guide member 42 which is fitted to the respective one of the vertical frames 14 and 15 and guides the moving direction of the shaft body 41 concerning its raising and lowering. A rolling roller may be fitted to the shaft body 41. The shaft body 41 is smoothly guided by the guide member 42 by the fitting of such a rolling roller. It should be noted that the supporting mechanism 32 may include a spring (not shown) serving as an urging member for resiliently urging the portion 31 upward or downward with respect to the window frame 2, so as to adjust the opening portion opening movement or opening portion closing movement of the framed panel 4.

The guide member 42 having a U-shaped cross section as shown in FIG. 3, in this embodiment, has a guide portion 43 for guiding the shaft body 41 in the vertical direction V, as well as another guide portion 44 which is connected to an upper end of the guide portion 43 and guides the shaft body 41 in an upwardly inclined direction from the building exterior 7 side toward the building interior 8 side with respect to the vertical direction V.

The guide portion 43 has a U-shaped cross section so as to form a groove 45 extending in the vertical direction V. The shaft body 41 is disposed in the groove 45 linearly movably in the vertical direction V. The guide portion 43 is adapted to guide the portion 31 in the vertical direction V by guiding the shaft body 41.

The guide portion 44 has a U-shaped cross section so as to form a groove 46 extending in the aforementioned inclined direction. The shaft body 41 is disposed in the groove 46 movably in the inclined direction. The guide portion 44 is adapted to guide the portion 31 in the aforementioned inclined direction by guiding the shaft body 41.

Figure 6:
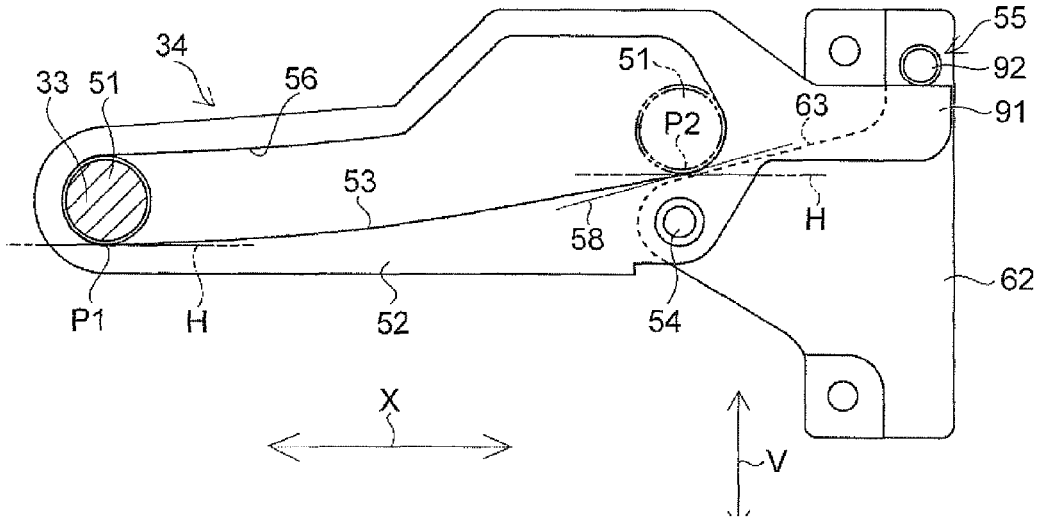
FIG. 6 is an explanatory diagram of mainly a second supporting mechanism of the embodiment shown in FIG. 1.
Figure 7:
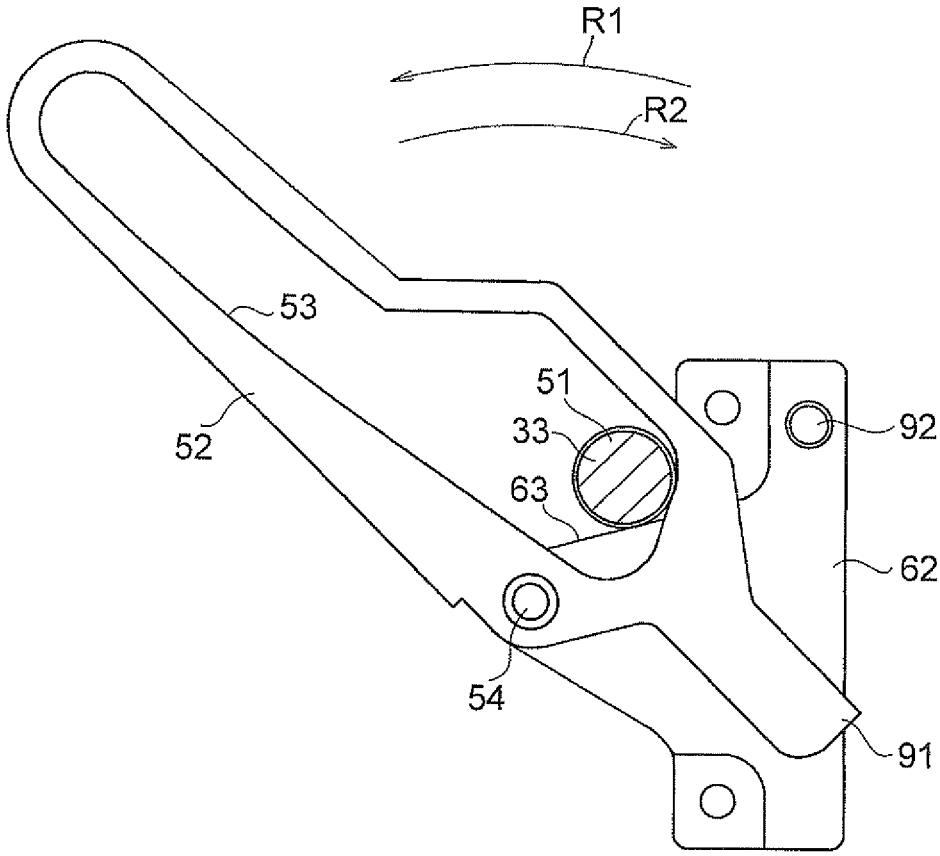
FIG. 7 is an explanatory diagram of mainly the second supporting mechanism of the embodiment shown in FIG. 1.

The supporting mechanism 34 includes a shaft body 51 which is fitted to the respective one of the portion 33 of the stile 24 and the portion 33 of the stile 25; a support member 52 for supporting the shaft body 51 by a supporting surface 53 movably in the direction X toward the interior or exterior of the building; another support member 62 which is fitted to the window frame 2 and supports the portion 33 by another supporting surface 63 movably in the direction X toward the interior or exterior of the building; a rotating shaft 54 which connects the support member 52 to the window frame 2 rotatably in R1 and R2 directions, so as to be located on the building interior 8 side and on a lower side with respect to the shaft body 51 in the state of being supported by the support member 52 movably in the direction X toward the interior or exterior of the building; and a holding mechanism 55 for holding the support member 52 in the state in which the support member 52 supports the shaft body 51 movably in the direction X toward the interior or exterior of the building, as shown in FIG. 6. A rolling roller may be fitted to the shaft body 51. The shaft body 51 is smoothly guided and supported by the supporting surface 53 by the fitting of such a rolling roller.

In the ease where the framed panel 4 is in the opening portion open position shown in FIG. 1, the shaft body 51 and a center of gravity G of the framed panel 4 are respectively located on an identical straight line extending in the vertical direction V. The shaft body 51 may be disposed on the framed panel 4 so as to be located above the center of gravity G of the framed panel 4 and to be located on the building exterior 7 side with respect to that center of gravity G in the case where the framed panel 4 is in the opening portion closed position, as shown in FIG. 2.

Figure 4:
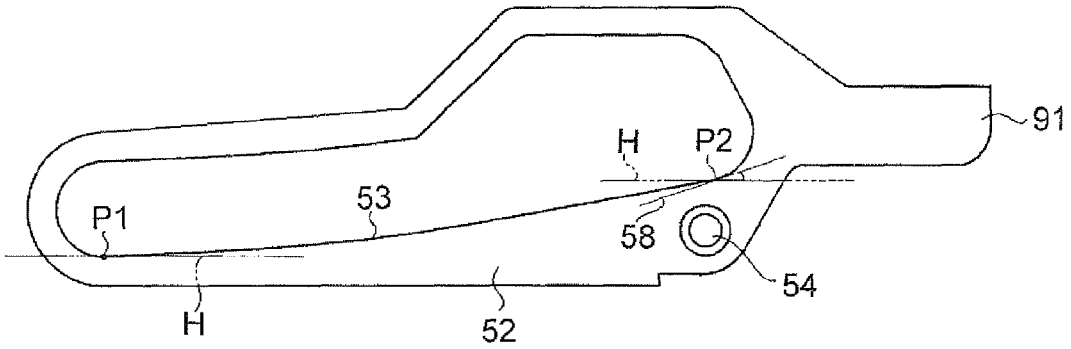
FIG. 4 is an explanatory diagram of mainly a support member of the embodiment shown in FIG. 1.

As shown in FIG. 4, for instance, the supporting surface 53 is inclined upward from the building exterior 7 side toward the building interior 8 side with respect to a horizontal line H, and an angle of inclination of the supporting surface 53 with respect to the horizontal line H increases gradually from the building exterior 7 side toward the building interior 8 side. The supporting surface 53 is constituted by a lower surface of an elongated hole 56 formed in the support member 52 in such a manner as to extend in the direction X toward the interior or exterior of the building. The angle of inclination of a tangential line of the supporting surface 53 to the shaft body 51 at an abutment point P1 with respect to the horizontal line H is 0 degree in the case where the framed panel 4 is in the opening portion open position. In the state in which the support member 52 projects to the building exterior 7 side and in which that support member 52 is being held by the holding mechanism 55, the angle of inclination of a tangential line 58 of the supporting surface 53 to the shaft body 51 located on the extreme building interior 8 side at an abutment point P2 with respect to the horizontal line H is 12 degrees, and such an angle becomes a maximum angle of inclination of the supporting surface 53 with respect to the horizontal line H. The angle of inclination of the supporting surface 53 with respect to the horizontal line H increases gradually from 0 degree to 12 degrees from the building exterior 7 side toward the building interior 8 side. The aforementioned angle of inclination of the supporting surface 53 increases gradually from the abutment point P1 to the abutment point P2. The shaft body 51 abutting against the supporting surface 53 is displaced upward as the shaft body 51 moves from the building exterior 7 side toward the building interior 8 side, whereas the shaft body 51 is displaced downward as it moves from the building interior 8 side toward the building exterior 7 side. Such a supporting surface 53 is adapted to support the shaft body 51 in the state in which the support member 52 in the main projects to the building exterior 7 side.

Figure 5:
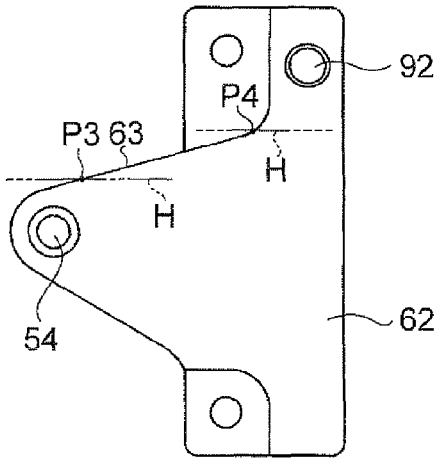
FIG. 5 is an explanatory diagram of mainly another support member of the embodiment shown in FIG. 1.

As shown in FIG. 5, for instance, the supporting surface 63 is inclined upward from the building exterior 7 side toward the building interior 8 side with respect to the horizontal line H, such that the support of the portion 33 is shifted from the supporting surface 53 to that supporting surface 63. An angle of inclination of the supporting surface 63 with respect to the horizontal line H increases gradually from the building exterior 7 side toward the building interior 8 side. The angle of inclination of the supporting surface 63 with respect to the horizontal line H is greater than a maximum angle of inclination of the supporting surface 53 with respect to the horizontal line H. The angle of inclination of a tangential line of the supporting surface 63 to the shaft body 51 located on the extreme building exterior 7 side at an abutment point P3 with respect to the horizontal line H is 12 degrees, and such an angle becomes a minimum angle of inclination of the supporting surface 63 with respect to the horizontal line H. In terms of the angle of inclination of the supporting surface 63 with respect to the horizontal line H, the angle of inclination of a tangential line of the supporting surface 63 to the shaft body 51 located on the extreme building interior 8 side at an abutment point P4 with respect to the horizontal line H is 15 degrees, and such an angle becomes a maximum angle of inclination of the supporting surface 63 with respect to the horizontal line H. The angle of inclination of the supporting surface 63 with respect to the horizontal line H increases gradually from 12 degrees to 15 degrees from the building exterior 7 side toward the building interior 8 side. The aforementioned angle of inclination of the supporting surface 63 increases gradually from the abutment point P3 to the abutment point P4. The shaft body 51 abutting against the supporting surface 63 is displaced upward as the shaft body 51 moves from the building exterior 7 side toward the building interior 8 side, whereas the shaft body 51 is displaced downward as it moves from the building interior 8 side toward the building exterior 7 side. Such a supporting surface 63 is adapted to support the shaft body 51 when the support member 52 in the main is rotated toward the building interior 8 side or toward the building exterior 7 side. The supporting surfaces 53 and 63 form a single foldable supporting surface for supporting the shaft body 51 in cooperation with each other.

If it is assumed that, on the basis of the inclination of the supporting surface 53 with respect to the horizontal line H, an opening portion opening movement force, which is imparted to the framed panel 4 whose portion 33 is supported by the supporting surface 53 or the supporting surface 63, is F, and that a force in the vertical direction V generated on the basis of the self weight of the framed panel 4 is mg, F can be determined from the formula below. By using this formula, the angle of inclination of each of the supporting surfaces 53 and 63 with respect to the horizontal line H is suitably set in relation to F.

$$F = mg \cdot \sin\theta \qquad \text{[Formula 1]}$$

Figure 9:
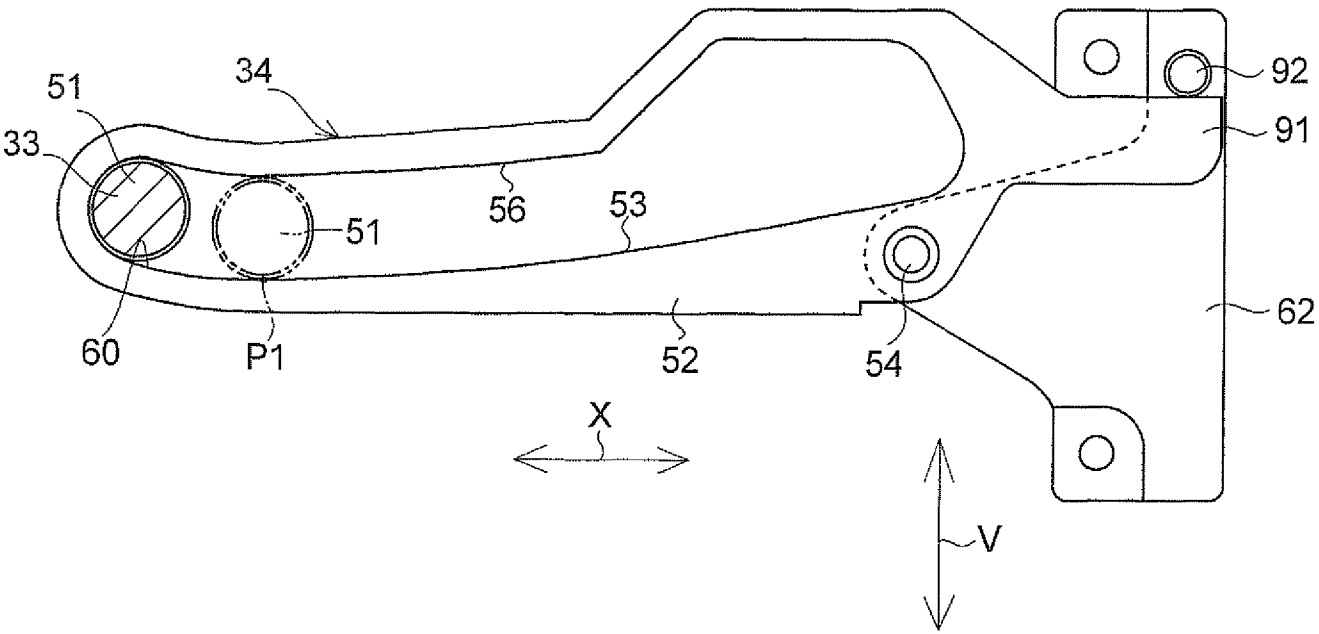
FIG. 9 is an explanatory diagram of mainly another second supporting mechanism of the embodiment shown in FIG. 1.

As shown in FIG. 9, for instance, the support member 52 may have, in addition to the supporting surface 53, an end side supporting surface 60 which is continuous to an end portion on the building exterior 7 side of the supporting surface 53 and abuts against the shaft body 51 to support the shaft body 51 movably in the direction X toward the interior or exterior of the building. Such an end side supporting surface 60 is inclined downward from the building exterior 7 side toward the building interior 8 side. The end side supporting surface 60 is constituted by the surface of a portion on the building exterior 7 side of the elongated hole 56 formed in the support member 52. The shaft body 51 abutting against the end side supporting surface 60 is displaced downward as the shaft body 51 moves from the building exterior 7 side toward the building interior 8 side, whereas the shaft body 51 is displaced upward as it moves from the building interior 8 side toward the building exterior 7 side. The angle of inclination of the end side supporting surface 60 with respect to the horizontal line H may increase gradually from the building interior 8 side toward the building exterior 7 side.

Figure 8:
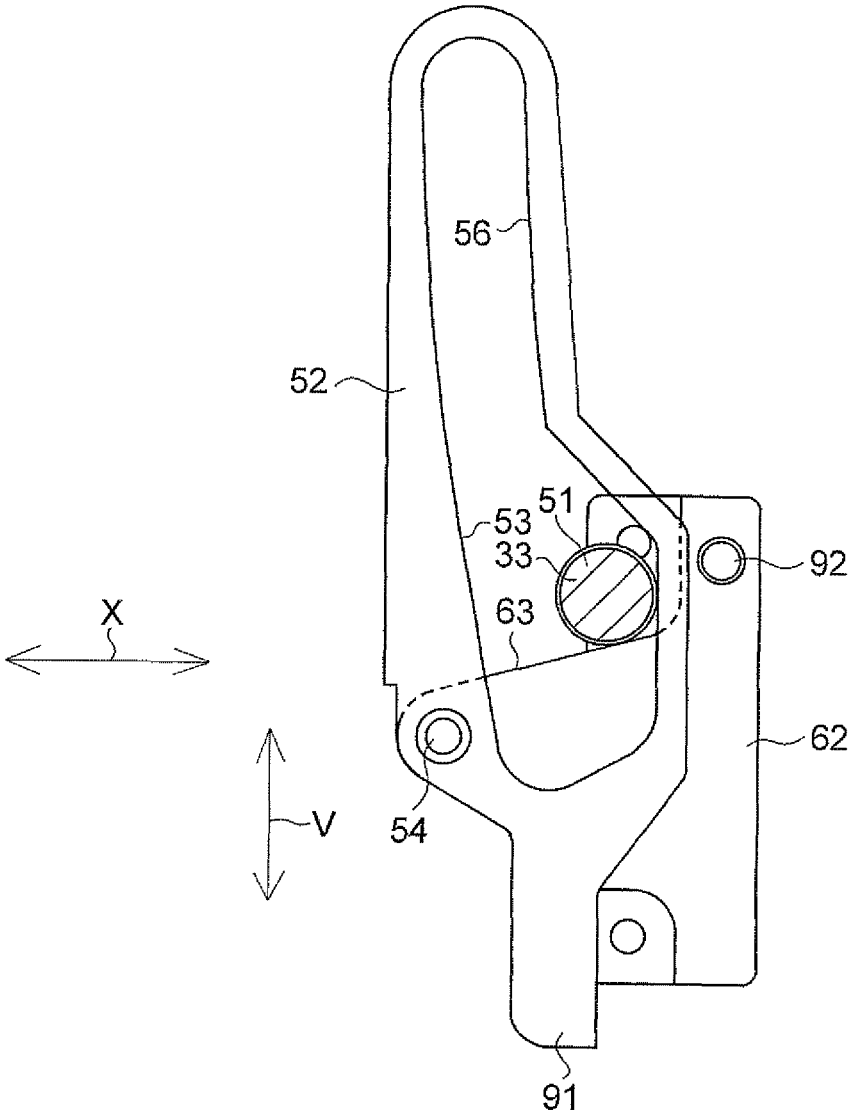
FIG. 8 is an explanatory diagram of mainly the second supporting mechanism of the embodiment shown in FIG. 1.

The support member 52 is rotated about the rotating shaft 54 in the R1 and R2 directions in conjunction with the opening portion opening movement and opening portion closing movement of the framed panel 4. When the opening portion is open, the support member 52 is disposed so as to project from the rotating shaft 54 toward the building exterior 7 side, as shown in FIGS. 1 and 6. Meanwhile, when the opening portion is closed, the support member 52 is disposed so as to project upward from the rotating shaft 54, as shown in FIGS. 2 and 8. When the opening portion is closed, since the support member 52 is disposed so as to project upward from the rotating shaft 54, the support member 52 itself does not project toward either the building exterior 7 side or the building interior 8 side.

The holding mechanism 55 has a retained projecting portion 91 which is formed integrally with an end portion on the building interior 8 side of the support member 52, as well as a retaining projecting portion 92 formed on the respective one of the stiles 24 and 25 and adapted to retain the retained projecting portion 91. The retained projecting portion 91 is rotated by the rotation in the R1 direction of the support member 52 about the rotating shaft 54, and abuts against the retaining projecting portion 92 when the support member 52 is disposed at the position shown in FIGS. 1 and 6, whereby this abutment retains that retained projecting portion 91 so as to prohibit the rotation of the support member 52 in the R1 direction by more than a predetermined amount toward the building exterior 7 side. When the rotation of the support member 52 is prohibited by such retention, the support member 52 assumes a state in which it projects toward the building exterior 7 side in the direction X toward the interior or exterior of the building.

In the case where the framed panel 4 is in the opening portion open position, the center of gravity G of the framed panel 4 and the portion 33 are respectively located on an identical straight line extending in the vertical direction V, so that the framed panel 4 is brought to a standstill by maintaining a balance owing to its own weight. The framed panel 4 in such a stationary state is in a state of being movable for closing the opening portion by a small force based on the air current. Here, if the framed panel 4 effects the opening portion closing movement from the opening portion open position, since the supporting surface 53 is inclined, as described above, an opening portion opening movement force, which serves as a counter moving force for resisting the opening portion closing movement force, is imparted to the framed panel 4. When the opening portion closing movement force exceeds the opening portion opening movement force as the counter moving force, the framed panel 4 effects the opening portion closing movement, whereas when the opening portion closing movement force is lower than the opening portion opening movement force as the counter moving force, the framed panel 4 effects the opening portion opening movement to return to the opening portion open position. Since the angles of inclination of the supporting surfaces 53 and 63 increase gradually, as described above, the opening portion opening movement force serving as the aforementioned counter moving force increases gradually as the framed panel 4 moves away from the opening portion open position toward the building interior 8 side.

When the framed panel 4 is in the opening portion closed position, a line connecting the portion 33 and the center of gravity G is inclined downward toward the building interior 8 side with respect to the vertical line (line extending in the vertical direction V). As the framed panel 4 approaches the opening portion open position owing to the opening portion opening movement, this angle of inclination decreases gradually and becomes 0 degree when the framed panel 4 is disposed in the opening portion open position. The line connecting the portion 33 of the framed panel 4 and the center of gravity G of the framed panel 4 located in the opening portion open position is parallel to the vertical line. In the case where the line connecting the portion 33 and the center of gravity G is inclined downward toward the building interior 8 side with respect to the vertical line, an opening portion opening movement force based on the self weight of the framed panel 4 is imparted to the framed panel 4. Meanwhile, in the case where the angle of inclination of the line connecting the portion 33 and the center of gravity G with respect to the vertical line has become 0 degree, the opening portion opening movement force in the relationship between the position of the portion 33 and the position of the center of gravity G is not generated.

The engaging means 35 has an engaging member 65 constituted by an L-shaped lever fitted rotatably to the bottom rail 23. As such an engaging member 65 is rotatively operated in the opening portion closed state, the engaging member 65 abuts against the lower frame 13 on the building interior 8 side and is thereby adapted to allow the framed panel 4 to engage the window frame 2. In addition, as the engaging member 65 is rotatively operated in the opposite direction to that of the aforementioned rotative operation, the engaging member 65 is moved away from the lower frame 13 and is thereby adapted to allow the framed panel 4 to be disengaged from the window frame 2.

A description will be given of the window opening and closing operation by the above-described natural ventilation apparatus 1. First, the opening portion opening movement of the framed panel 4 which is in the opening portion closed position shown in FIG. 2 is allowed by canceling the engagement between the framed panel 4 and the window frame 2 by the engaging means 35. When the opening portion opening movement of the framed panel 4 is allowed by the cancellation of the engagement by the engaging means 35, since the portion 33 is located on the building exterior 7 side with respect to the center of gravity G in the direction X toward the interior or exterior of the building, and the shaft body 51 is supported by the supporting surface 63 which is inclined with respect to the horizontal line H, a rotational moment toward the opening portion open position is imparted to the framed panel 4, so that the framed panel 4 starts the opening portion opening movement. The support member 52 which is in the state shown in FIG. 8 is rotated in the R1 direction toward the building exterior 7 side in conjunction with such opening portion opening movement, and after undergoing the state shown in FIG. 7, the support member 52 projects toward the building exterior 7 side, as shown in FIG. 6, and is supported by the holding mechanism 55. When the support member 52 is held by the holding mechanism 55, the support of the shaft body 51 by the supporting surface 63 shifts to the support of the shaft body 51 by the supporting surface 53. The shaft body 41 is lowered along the grooves 45 and 46 in conjunction with the movement of the portion 33 toward the building exterior 7 side. Since the angle of inclination of the supporting surface 53 and the angle of inclination of the line connecting the portion 33 and the center of gravity G with respect to the vertical line decrease gradually as the framed panel 4 approaches the opening portion open position, the rotational moment toward the opening portion open position, which is imparted to the framed panel 4, becomes gradually small. When the framed panel 4 reaches the opening portion open position due to the opening portion opening movement, the portion 33 and the center of gravity G are located on the identical straight line extending in the vertical direction V, as shown in FIG. 1. Consequently, the opening portion opening movement force based on the self weight of the framed panel 4 ceases to be generated, so that the framed panel 4 is brought to a standstill in the opening portion open position. Since the rotational moment toward the opening portion open position, which is imparted to the framed panel 4, thus becomes gradually small, it is possible to prevent the rapid opening of the opening portion by the framed panel 4. On the other hand, when the framed panel 4 conversely effects the opening portion closing movement from the opening portion open position toward the opening portion closed position, the rotational moment toward the opening portion open position, which is imparted to the framed panel 4, becomes gradually large. Therefore, the opening portion opening movement force serving as the aforementioned counter moving force resisting the opening portion closing movement becomes gradually large, with the result that it is possible to prevent the rapid closing of the opening portion.

In the case where the framed panel 4 is disposed in the opening portion open position, when the building exterior 7 side assumes a positive pressure and the building interior 8 side assumes a negative pressure with respect to the framed panel 4 owing to the air current, an opening portion closing movement force based on the air current is imparted to the framed panel 4. When the framed panel 4 effects the opening portion closing movement due to the opening portion closing movement force based on this air current, the flow rate of air flowing between the building exterior 7 and the building interior 8 decreases. On the other hand, when the building exterior 7 side assumes a negative pressure and the building interior 8 side assumes a positive pressure with respect to the framed panel 4 owing to the air current, an opening portion opening movement force based on the air current is imparted to the framed panel 4. When the framed panel 4 effects the opening portion opening movement due to the opening portion opening movement force based on this air current, the flow rate of air flowing between the building exterior 7 and the building interior 8 increases. When the opening portion opening movement force and the opening portion closing movement force based on the air current cease to be generated, the framed panel 4 is returned to the opening portion open position and is brought to a standstill, as described above.

In the natural ventilation apparatus 1, the engaging member 65 fitted to the framed panel 4 is pulled from building interior 8 side by a manual operation to dispose the framed panel 4 in the opening portion closed position, and that engaging member 65 is engaged with the lower frame 13, thereby maintaining the closed state of the opening portion 3.

According to the above-described natural ventilation apparatus 1, the natural ventilation apparatus 1 is comprised of the window frame 2 which is installed in the building; the framed panel 4 disposed in the opening portion 3 defined by the window frame 2; and the opening/closing means 5 for opening and closing the opening portion 3 on the basis of an air current. The opening/closing means 5 includes the supporting mechanism 32 adapted to support the one portion 31 of the framed panel 4 liftably, as well as the supporting mechanism 34 adapted to support the other portion 33 of the framed panel 4, which is located below the portion 31, movably in the direction X toward the interior or exterior of the building. The supporting mechanism 34 has the support member 52 for supporting the portion 33 by the supporting surface 53 movably in the direction X toward the interior or exterior of the building. The supporting surface 53 is inclined upward from the building exterior 7 side toward the building interior 8 side with respect to the horizontal line H, and the angle of inclination of the supporting surface 53 with respect to the horizontal line H increases gradually from the building exterior 7 side toward the building interior 8 side. Therefore, it is possible to ensure that in the case where the framed panel 4 is located in the opening portion open position or its vicinity, the framed panel 4 is allowed to undergo the opening portion opening/closing movement by a small force based on the air current, whereas in the case where the framed panel 4 is located in the vicinity of the opening portion closed position, the framed panel 4 is not allowed to undergo the opening portion closing movement by the force based on the air current. Thus, it is possible to suitably provide ventilation by the opening/closing movement, based on the air current, of the framed panel 4 located in the opening portion open position or its vicinity.

In the natural ventilation apparatus 1, the support member 52 may have the end side supporting surface 60 which is continuous to the building exterior 7 side end portion of the supporting surface 53 and abuts against the portion 33 to support the portion 33 movably in the direction X toward the interior or exterior of the building. The end side supporting surface 60 may be inclined downward from the building exterior 7 side toward the building interior 8 side. In such a case, with respect to the portion 33 abutting against the end side supporting surface 60, a counter moving force resisting the opening portion opening movement force can be imparted to the framed panel 4, thereby making it possible to prevent the rapid opening portion opening movement of the framed panel located in the opening portion open position or its vicinity.

According to the natural ventilation apparatus 1, there are provided the rotating shaft 54 which connects the support member 52 to the window frame 2 rotatably about the horizontal axis, so as to be located on the building interior 8 side and on a lower side with respect to the portion 33 in the state of being supported by the support member 52 movably in the direction X toward the interior or exterior of the building, as well as the holding mechanism 55 for holding the support member 52 in the state in which the support member 52 supports the portion 33 movably in the direction X toward the interior or exterior of the building. Therefore, as the support member 52 undergoes rotation toward the building interior 8 side, the support member 52 is not caused to project toward either the building interior 8 side or the building exterior 7 side when the framed panel 4 is in the opening portion closed position.

According to the natural ventilation apparatus 1, there is provided the other support member 62 which is fitted to the window frame 2 and supports the portion 33 by the other supporting surface 63 movably in the direction X toward the interior or exterior of the building. The supporting surface 63 is inclined upward from the building exterior 7 side toward the building interior 8 side with respect to the horizontal line H, such that the support of the portion 33 is shifted from the supporting surface 53 to that supporting surface 63. Since the angle of inclination of the supporting surface 63 with respect to the horizontal line H increases gradually from the building exterior 7 side toward the building interior 8 side, even in the case where the framed panel 4 is located in the opening portion closed position or its vicinity, an opening portion opening movement force can be imparted to the framed panel as a counter moving force resisting the opening portion closing movement force based on the air current. In addition, the opening portion opening movement of the framed panel 4 in the opening portion closed position or its vicinity can be effected smoothly.

According to the natural ventilation apparatus 1, since the angle of inclination of the supporting surface 63 with respect to the horizontal line H is greater than a maximum angle of inclination of the supporting surface 53 with respect to the horizontal line H, the closing of the opening portion is not effected rapidly, so that it is possible to prevent the occurrence of a situation such as the slamming of the framed panel 4 against the window frame 2, and the opening portion opening movement of the framed panel 4 in the opening portion closed position or its vicinity can be effected more smoothly.

According to the natural ventilation apparatus 1, the portion 33 of the framed panel 4 in the opening portion open position and the center of gravity G of that framed panel 4 are respectively located on the identical straight line extending in the vertical direction V. Therefore, it is possible to balance the framed panel 4 in the opening portion open position without needing to install a weight or the like on the framed panel 4, and it is possible to stop the opening portion opening movement of the framed panel 4 without using a stopper or the like. Moreover, the framed panel 4 can be made stationary in the opening portion open position so that the framed panel 4 can generate the opening portion opening/closing movement with a small force based on the air current.

The invention claimed is:

1. A natural ventilation apparatus comprising: a window frame which is installed in a building; a framed panel disposed in an opening portion defined by said window frame; and an opening and closing means for allowing the framed panel to open and close the opening portion on the basis of an air current, wherein said opening and closing means includes a first supporting mechanism for supporting one portion of said framed panel liftably in a vertical direction and a second supporting mechanism for supporting another portion of said framed panel, which is located below said one portion of said framed panel in the vertical direction, movably in a direction toward an interior or exterior of the building and wherein the direction is perpendicular to the vertical direction, said first supporting mechanism includes a portion of a slot that has a longitudinal axis extending to parallel to the vertical direction, said second supporting mechanism having a shaft body which is fitted to said another portion of said framed panel; a support member having a supporting surface for movably supporting said shaft body in the direction toward the interior or exterior of the building, a longitudinal axis of the support member being parallel to a horizontal direction in a state where said framed panel is in an open position the horizontal direction extending substantially 90 degrees to the vertical direction, said supporting surface being inclined upward from a building exterior side toward a building interior side with respect to the horizontal direction, an angle of inclination of said supporting surface with respect to the horizontal direction increasing from the building exterior side toward the building interior side.

2. The natural ventilation apparatus according to claim 1, wherein said support member has an end side supporting surface which is continuous to an end portion on the building exterior side of said supporting surface and abuts against said another portion of said framed panel to support said another portion movably in the direction toward the interior or exterior of the building, said end side supporting surface being inclined downward from the building exterior side toward the building interior side.

3. The natural ventilation apparatus according to claim 1, further comprising: a rotating shaft which connects said support member to said window frame rotatably about a horizontal axis, so as to be located on the building interior side and below said one portion of said framed panel, and a holding mechanism for holding said support member in a state in which said support member supports said another portion of said framed panel movably in the direction toward the interior or exterior of the building.

4. The natural ventilation apparatus according to claim 3, further comprising: another support member which is fitted to said window frame and supports said another portion of said framed panel by another supporting surface movably in the direction toward the interior or exterior of the building, said other supporting surface being inclined upward from the building exterior side toward the building interior side with respect to the horizontal direction, such that the support of said another portion of said framed panel is shifted from said supporting surface to said other supporting surface, an angle of inclination of said other supporting surface with respect to the horizontal direction increasing from the building exterior side toward the building interior side.

5. The natural ventilation apparatus according to claim 4, wherein the angle of inclination of said other supporting surface with respect to the horizontal direction is greater than a maximum angle of inclination of said supporting surface with respect to the horizontal direction.

6. The natural ventilation apparatus according to claim 1, wherein said another portion of said framed panel in an opening portion open position and a center of gravity of said framed panel are respectively located on an identical straight line extending in a vertical direction.

7. The natural ventilation apparatus according to claim 1, wherein said opening and closing means has engaging means for causing said framed panel in an opening portion closed position to engage said window frame.

* * * * *